US009936852B2

(12) United States Patent
Forst et al.

(10) Patent No.: US 9,936,852 B2
(45) Date of Patent: Apr. 10, 2018

(54) METHOD FOR FILLING A WASH TUB OF A DISHWASHER WITH WATER

(75) Inventors: Klaus-Martin Forst, Petersworth (DE); Gerhard Haider, Stockholm (SE); Hansjorg Lampe, Nuremberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 817 days.

(21) Appl. No.: 13/635,586

(22) PCT Filed: Mar. 16, 2011

(86) PCT No.: PCT/EP2011/001290

§ 371 (c)(1),
(2), (4) Date: Sep. 17, 2012

(87) PCT Pub. No.: WO2011/113583

PCT Pub. Date: Sep. 22, 2011

(65) Prior Publication Data

US 2013/0008477 A1 Jan. 10, 2013

(30) Foreign Application Priority Data

Mar. 18, 2010 (SE) ..... 1000247
Mar. 18, 2010 (SE) ..... 1000248
(Continued)

(51) Int. Cl.
*A47L 15/46* (2006.01)
*A47L 15/42* (2006.01)
*A47L 15/00* (2006.01)

(52) U.S. Cl.
CPC ..... *A47L 15/421* (2013.01); *A47L 15/0023* (2013.01); *A47L 15/0049* (2013.01);
(Continued)

(58) Field of Classification Search
CPC ..... A47L 15/0023; A47L 15/0055; A47L 15/4217; A47L 2401/14; A47L 2501/04;
(Continued)

(56) References Cited

U.S. PATENT DOCUMENTS 2,692,602 A 10/1954 Stanitz et al.
3,160,170 A 12/1964 Sampsel
(Continued)

FOREIGN PATENT DOCUMENTS

CH 665547 A5 5/1988
DE 28 18 062 A1 3/1980
(Continued)

OTHER PUBLICATIONS

Written Opinion for International Application No. PCT/EP2011/001290 dated Sep. 26, 2011.
(Continued)

*Primary Examiner* — Michael E Barr
*Assistant Examiner* — Tinsae B Ayalew
(74) *Attorney, Agent, or Firm* — Alston & Bird LLP

(57) ABSTRACT

A method for filling a wash tub (12) of a dishwasher (10) with water, wherein the wash tub (12) comprises a water-collecting sump pot (16) that is fixed to an opening in its bottom and said method forms part of a program cycle for the operation of the dishwasher, said method comprising the subsequent steps of: (i) opening a water inlet (13) of the dishwasher and executing a static filling of the wash tub wherein a circulation pump of the dishwasher is kept deactivated, (ii) detecting a predetermined lower water level (22) inside the sump pot (16), and (iii) starting to measure the time for the static filling when said lower water level (22) is detected.

18 Claims, 2 Drawing Sheets

(30) Foreign Application Priority Data

Figure 1:
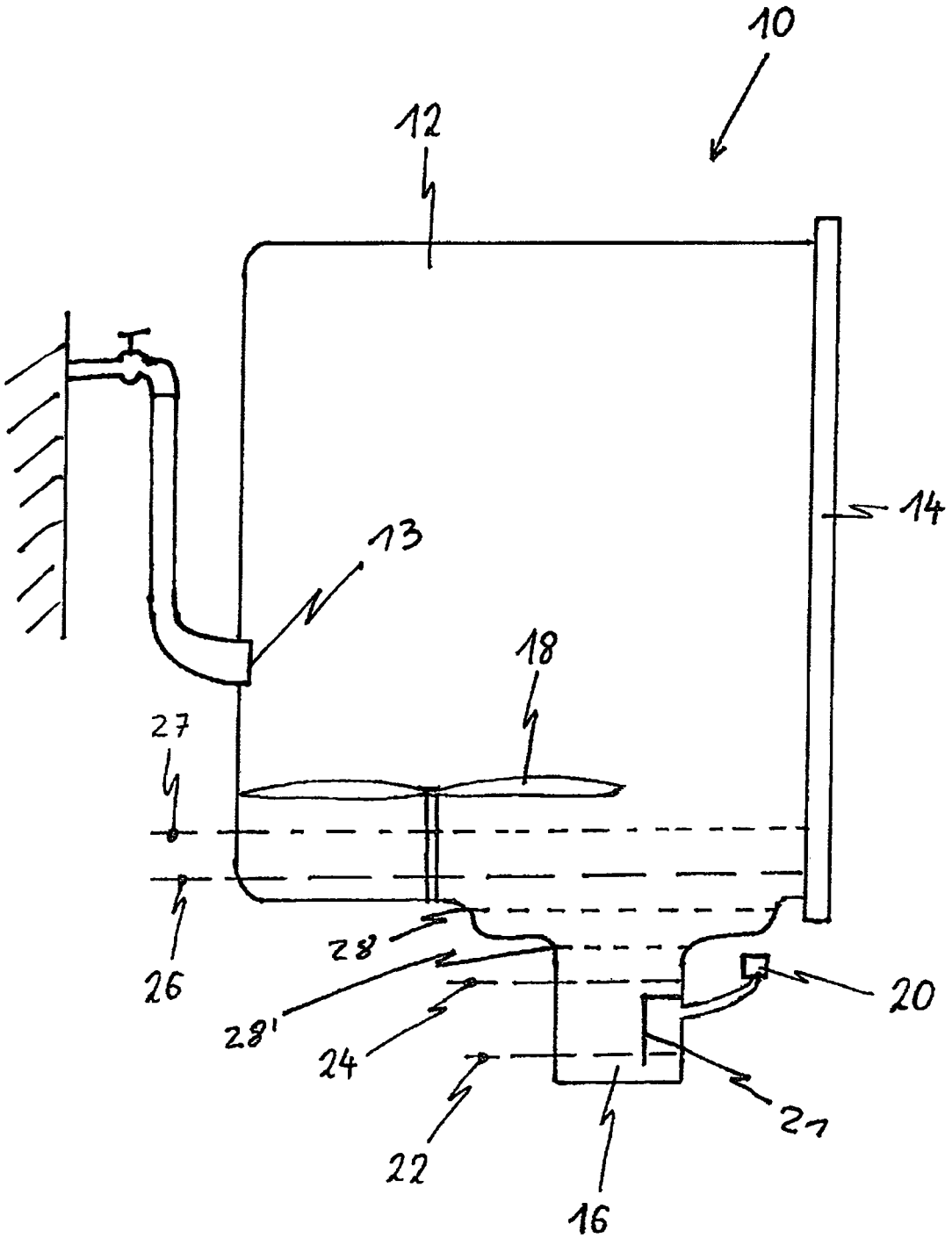

Mar. 19, 2010 (EP) ..... 10002934
Mar. 19, 2010 (SE) ..... 1000256
Apr. 1, 2010 (EP) ..... 10003648

(52) U.S. Cl.
CPC ..... *A47L 15/4229* (2013.01); *A47L 15/4217* (2013.01); *A47L 2401/06* (2013.01); *A47L 2401/09* (2013.01); *A47L 2401/20* (2013.01); *A47L 2501/01* (2013.01); *A47L 2501/02* (2013.01); *A47L 2501/26* (2013.01); *A47L 2501/28* (2013.01); *A47L 2501/34* (2013.01)

(58) Field of Classification Search
CPC ..... D06F 39/02; D06F 39/088; D06F 39/087; D06F 2202/08; D06F 2204/08; D06F 2204/086
USPC ..... 134/186; 8/158; 68/12.05, 207, 12.02
See application file for complete search history.

(56) References Cited

U.S. PATENT DOCUMENTS

| | | | | |
|---|---|---|---|---|
| 5,257,171 | A | 10/1993 | Hara | |
| 5,409,023 | A | 4/1995 | Santarossa et al. | |
| 5,443,655 | A | 8/1995 | Stover et al. | |
| 5,470,142 | A | 11/1995 | Sargeant et al. | |
| 5,525,161 | A | 6/1996 | Milocco et al. | |
| 5,560,060 | A | 10/1996 | Dausch et al. | |
| 5,634,227 | A | 6/1997 | Lim | |
| 7,195,023 | B2 | 3/2007 | McKee et al. | |
| 7,332,041 | B2 | 2/2008 | McKee et al. | |
| 7,988,789 | B2 | 8/2011 | Elick et al. | |
| 8,608,866 | B2 | 12/2013 | Francisco et al. | |
| 2003/0188767 | A1 | 10/2003 | Durfee | |
| 2004/0236522 | A1 | 11/2004 | Howes, Jr. et al. | |
| 2004/0255976 | A1 | 12/2004 | DuHack et al. | |
| 2005/0005952 | A1* | 1/2005 | Bashark | A47L 15/0023 134/18 |
| 2005/0178406 | A1 | 8/2005 | Kang | |
| 2007/0017551 | A1 | 1/2007 | Hartogh | |
| 2007/0181154 | A1* | 8/2007 | Beer | A47L 15/0002 134/18 |
| 2008/0190453 | A1 | 8/2008 | Hildenbrand | |
| 2009/0038644 | A1 | 2/2009 | Fauth et al. | |
| 2010/0229893 | A1 | 9/2010 | Herrmann | |
| 2011/0000510 | A1 | 1/2011 | Mersch et al. | |
| 2011/0114141 | A1 | 5/2011 | Classen et al. | |
| 2011/0226287 | A1 | 9/2011 | Elick et al. | |
| 2011/0297189 | A1 | 12/2011 | Gram et al. | |
| 2012/0145194 | A1 | 6/2012 | Jerg et al. | |
| 2012/0145200 | A1 | 6/2012 | Jerg et al. | |
| 2013/0025637 | A1 | 1/2013 | Francisco et al. | |
| 2014/0158163 | A1 | 6/2014 | Montgomery et al. | |
| 2017/0119229 | A1 | 5/2017 | Montgomery et al. | |

FOREIGN PATENT DOCUMENTS

| | | | | |
|---|---|---|---|---|
| DE | 35 27 046 | A1 | 2/1987 | |
| DE | 35 27 047 | A1 | 2/1987 | |
| DE | 38 39 200 | A1 | 5/1990 | |
| DE | 42 22 240 | A1 | 1/1994 | |
| DE | 42 38 450 | A1 | 5/1994 | |
| DE | 196 51 297 | A1 | 6/1998 | |
| DE | 197 58 064 | A1 | 7/1999 | |
| DE | 198 28 768 | A1 | 1/2000 | |
| DE | 20 2006 00256 | U1 | 6/2006 | |
| DE | 10 2007 056918 | B3 | 4/2009 | |
| DE | 10 2007 052085 | A1 | 5/2009 | |
| DE | 10 2011 051356 | A1 | 12/2012 | |
| DE | 10 2011 051725 | A1 | 1/2013 | |
| EP | 0 086 037 | A1 | 8/1983 | |
| EP | 0 094 357 | A1 | 11/1983 | |
| EP | 0 685 198 AI | | 12/1995 | |
| EP | 0 779 056 | A2 | 6/1997 | |
| EP | 1 023 868 | A2 | 8/2000 | |
| EP | 1 030 236 | A2 | 8/2000 | |
| EP | 1029498 | A2 * | 8/2000 | A47L 15/4225 |
| EP | 1 211 344 | A1 | 6/2002 | |
| EP | 1211344 | A1 * | 6/2002 | A47L 15/4244 |
| EP | 1 352 605 | A1 | 10/2003 | |
| EP | 1 842 478 | A1 | 10/2007 | |
| EP | 1 905 339 | A1 | 4/2008 | |
| EP | 2 289 388 | A2 | 3/2011 | |
| FR | 2 480 104 | A1 | 10/1981 | |
| FR | 2480104 | A1 * | 10/1981 | A47L 15/4244 |
| FR | 2 558 713 | A1 | 8/1985 | |
| GB | 1 283 681 | A | 8/1972 | |
| GB | 2 423 371 | A | 8/2008 | |
| JP | 32-36822 | A | 10/1991 | |
| JP | 40-97735 | A | 3/1992 | |
| JP | 70-59707 | A | 3/1995 | |
| JP | 2000-271060 | A | 10/2000 | |
| JP | 2002-71060 | A | 10/2000 | |
| JP | 2001-057957 | A | 3/2001 | |
| JP | 2002-263050 | A | 9/2002 | |
| JP | 2007-007178 | A | 1/2007 | |
| WO | WO 01/18298 | A2 | 3/2001 | |
| WO | WO 2007/049177 | A2 | 5/2007 | |
| WO | WO 2009/004019 | A1 | 1/2009 | |
| WO | WO 2013/016329 | A1 | 1/2013 | |

OTHER PUBLICATIONS

Extended European Search Report from European Application No. 10002934.7 dated Sep. 13, 2011.
Partial European Search Report from European Application No. 10002934.7 dated Sep. 16, 2010.
Extended European Search Report from European Application No. 10003648.2 dated Sep. 1, 2011.
Partial European Search Report from European Application No. 10003648.2 dated Sep. 13, 2010.
Office Action from Chinese Patent Application No. 201180025261.3 dated Oct. 10, 2014.
International Search Report for Application No. PCT/EP2011/001290 dated Sep. 19, 2011.
International Search Report and Written Opinion for Application No. PCT/US2014/036519, dated Jan. 20, 2015.
Office Action from European Patent Application No. 10002934.7 dated Sep. 9, 2014.
Office Action for Canadian Application No. 2,793,083 dated Dec. 12, 2016.
Office Action for U.S. Appl. No. 15/300,836 dated Jun. 22, 2017.
Office Action for U.S. Appl. No. 15/300,836 dated May 22, 2017.

* cited by examiner

METHOD FOR FILLING A WASH TUB OF A DISHWASHER WITH WATER

CROSS REFERENCE TO RELATED APPLICATIONS

This application is a national stage application filed under 35 U.S.C. 371 of International Application No. PCT/EP2011/001290, filed Mar. 16, 2011, which claims priority from Swedish Patent Application No. 1000248-3, filed Mar. 18, 2010; Swedish Patent Application No. 1000247-5, filed Mar. 18, 2010; Swedish Patent Application No. 1000256-6, filed Mar. 19, 2010; European Patent Application No. 10002934.7, filed Mar. 19, 2010; European Patent Application No. 10003648.2, filed Apr. 1, 2010, each of which is incorporated by reference herein in its entirety.

The present invention relates to a method for filling a wash tub of a dishwasher with water, wherein said method forms a part of a program cycle for the operation of the dishwasher.

A method for the operation of dishwashers is already known from DE 198 28 768 C2 wherein the wash tub of the dishwasher is filled with fresh water until a minimum working level is reached inside a sump pot of the wash chamber and said minimum is set such that the circulation the dishwashers does not suck air. The minimum working level is measured by a level sensor that comprises an air trap and a pressure sensor. However, the accuracy of the level measurement of the prior art is not sufficient for modern dishwashers that require filling methods which shall use less water for ecological reasons.

Frequently, pressure switches having a single switch level have been used in the prior art for controlling the filling of a dishwasher with water. Higher accuracy of the filling could in principle be reached in the prior art by using a plurality of pressure switches, each detecting a different switch level, or by using an expensive pressure switch detecting a plurality of pressure levels. However, the tolerances of the individual pressure switches work against each other, thus increasing the tolerance between two levels. Further, the conventional pressure switches require a lot of space and costs for components, also making the dishwasher too complex in production.

It is an object of the present invention to provide a method for filling a wash tub of a dishwasher with water, wherein said method forms a part of a program cycle for the operation of the dishwasher, which method allows an increased accuracy, and/or an increased water safety.

The object of the present invention is achieved by the method hob according to claim 1.

According to the present invention the method for filling a wash tub of a dishwasher with water, wherein the wash tub comprises a water-collecting sump pot that is fixed to an opening in its bottom and said method forms part of a program cycle for the operation of the dishwasher, comprises the subsequent steps of:

(i) opening a water inlet of the dishwasher and executing a static filling of the wash tub wherein a circulation pump of the dishwasher is kept deactivated, (ii) detecting a predetermined lower water level inside the sump pot, and (iii) Starting to measure the time for the static filling when said lower water level is detected.

Further novel and inventive features of the present invention are set forth in the depended claims.

A first central proposal of the present invention is to use an analogue pressure sensor, such as is known per se in the prior art and described for example in DE 20 2006 002 561 U1, for monitoring the pressure of the inlet water during the filling of the wash tub of the dishwasher. The analogue pressure sensor is for example able to measure the pressure over a range of about 0 mmWc to 150 mmWc. In contrast, the pressure switches used in the prior art can detect individual water levels, but they cannot measure over a continuous pressure range when a higher accuracy is required. Therefore, the accuracy of monitoring a water filling process in a wash tub requires the use of several pressure switches of the prior art or the use of an expensive switch with several switch levels, so that more space and costs for components are necessary and the dishwasher is more complex.

In general, the analogue pressure sensor is provided for detecting the pressure in the air or water. The pressure range of the analogue pressure sensor is adapted to the appliance. For the dishwasher the pressure range of the analogue pressure sensor 20 is preferably between 0 mmWc and about 200 mmWc (mm water column).

The output signal of the analogue pressure sensor corresponds with a detected pressure value. For example, the output signal of the analogue pressure sensor can be defined by its voltage, current or frequency. The resolution of the analogue pressure sensor can vary. In this it is particularly preferred that the resolution of the analogue pressure sensor should be 1 mmWc. Unlike a conventional pressure switch used in dishwashers the analogue pressure sensor can recognize typically about 200 different water levels. In contrast, the conventional pressure switch triggers on only one predetermined pressure value. According to the invention, the water filling method is controlled in that the output signal of the analogue pressure sensor is treated and evaluated by an electronic control unit. Said electronic control unit can control the behaviour of the dishwasher in dependence of the detected pressure value.

An important further advantage of the use of the analogue pressure sensor is that unlike conventional mechanical pressure switches the analogue pressure sensor can be calibrated to reference levels, which are given by conditions during the washing process or by other sensors. Thus, different influences as the temperature and the drift over the lifetime are eliminated and the accuracy is improved. Any residual water cannot disturb the measuring of the pressure.

A first aspect of the present invention refers to a novel filling routine for the wash tub of the dishwasher with water that provides a previously unknown accuracy and a correspondingly improved water saving and water safety. A schematic flow chart of a method for filling the wash tub with water according to the present invention is shown in table I.

TABLE I

| |
|---|
| Initial state |
| ↓ |
| Calibrating |
| ↓ |
| Static filling |
| ↓ |
| Calculating |
| ↓ |
| Percentaged filling |
| ↓ |
| Dynamic filling |
| ↓ |
| Refilling |

In an initial state the wash tub and the sump pot are empty. In this state the dishwasher is clean and ready to be started.

In a preliminary calibrating step the analogue pressure sensor and/or a connected electronic control circuit of the dishwasher are preferably set to a basis value (offset calibration). A zero point of the analogue pressure sensor can be newly determined, while a drain pump is running before the start of a new program cycle, preferably at the end of the preceding program cycle. The corresponding pressure measurement can be executed during each program cycle. Preferably, the measurement is executed in a predetermined time point of a first drain step, e.g. said predetermined time point is at the end of the first drain step. A first and a second measurement can be taken for a plausibility test.

A further central proposal of the present invention is to measure the time for the static filling, i.e. while the circulation pump of the dishwasher is kept switched off, with inlet water corresponding to a known volume between two predetermined water levels, both of which are comprised within the sump pot. Advantageously, the analogue pressure sensor is not only used to measure the pressure corresponding to the upper water level, which is preferably within the sump pot. But the analogue pressure sensor can in addition detect already when the filling water reaches the lower level in the bottom region of the sump pot, which thus can be used as the starting point of the initial static filling step. This is novel, because in the prior art, the starting point for the filling with water was simply assumed to be zero, since the sump pot was expected to be empty. This assumption however could lead to an inadequate volume of water inside the wash tub, if water has remained in the sump pot in a previous wash cycle against the expectations. Typically, such a wrong filling results in a too high volume of water inside the wash tub if the filling involves opening of the water inlet for a predetermined time or is based on measuring the volume of the filled-in water.

Referring to the method of the invention according to claim 1, during the step of static filling according to the novel filling routine, the circulation pump of the dishwasher for generating pressurized water for spraying onto the wash load is kept deactivated. At first water is filled into the lower portion of the sump pot, filling it to the predetermined lower water level in the bottom region of the sump pot. With advantage, the predetermined lower water level can be set such that it is higher than any level of residual water that remains inside the bottom region of the sump pot after a correct final drainage step of a wash cycle.

In a preferred embodiment of the invention, an air trap is arranged inside the sump pot, wherein a connecting tube of the pressure sensor, preferably of an analogous pressure sensor, branches of an upper portion of the air trap and the lower edge of the air trap is arranged at a relatively small distance from the bottom of the sump pot as compared to the overall height of the sump pot, in particular as compared to the height of the sump pot up to at least the predetermined upper water level. Said small distance is preferably chosen such that it is not reached by any level of residual water that remains inside the bottom region of the sump pot after a correctly executed final drainage step of a wash cycle. However, the predetermined lower water level in the sump pot that is the starting level of the static filling is arranged somewhat above the lower edge of the air trap. That arrangement has the advantage that said predetermined lower water level will give a clearly different pressure signal as compared to an empty sump or to any level of residual water that remains inside the bottom region of the sump pot after a correct final drainage step which both give a pressure signal that corresponds to the atmospheric pressure.

Importantly, the static filling is monitored and it is detected when said predetermined lower level is reached. When reaching the predetermined lower water level, a first time T1 is recorded as the start time of the static filling step. A first lower pressure P1 of the filled water that corresponds to the start time T1 of the static filling can be detected at said predetermined lower water level by the analogue pressure sensor.

Subsequently, the static filling is continued until a second higher water level or static filling level is detected preferably inside the sump pot. A second upper pressure P2 of the filled water that corresponds to the end time T2 of the static filling can be detected at said predetermined upper water level by the analogue pressure sensor.

In a next step of calculating, upon detecting said predetermined upper water level or static filling level the static filling is stopped, (iv) a predetermined upper water level is detected inside the sump pot and the static filling is stopped, and (v) the flow rate of the inlet water during the static filling is determined basing on the duration of the static filling and on a known sump pot volume comprised between said upper water level and said lower water level of the sump pot.

The flow rate of the inlet water is calculated. At first the difference of the times T2 and T1 is calculated. Said difference is the time for filling a volume between the predetermined lower water level and the predetermined upper level or static fill level. Since the volume of the sump pot and in particular the volume between the predetermined lower water level and the predetermined upper level static fill level is known, the flow rate can be calculated by dividing said volume and the above difference of the times T2 and T1.

A major proposal of the present invention refers to the execution of the above-described static filling within the sump pot. The lower portion of the sump pot, which includes the predetermined lower water and the predetermined upper level or static fill level, has a relatively small cross-section as compared to the bottom region of the wash chamber which is arranged on top of the sump pot. Thus, a change of the level in said lower portion of the sump pot corresponds with a relative small change of the volume. The lower portion of the sump pot can have for example a cylindrical shape.

Since the detected pressure of the analogue pressure sensor corresponds with the level, the change of the volume can be determined with high accuracy within said lower portion of the sump pot that has a relatively small cross-section, i.e. at least between said predetermined lower water level and said predetermined upper water level of the static filling step of the invention. In the bottom region of the wash tub or with some sump pots already in an upper portion of the sump pot the cross-section becomes wider. Herein however it is intended that said predetermined upper level or switch level of the static filling shall be arranged in a region of the sump pot that has an advantageous relatively small cross-section. As has been said already, the volume between the predetermined lower water level and the predetermined upper level or static fill level is known. It can be in an advantageous example—without any limitation to the invention or its dependent future improvements—in the range of one liter.

The calculation of the flow rate between two different predetermined levels, namely the predetermined lower water level and the predetermined upper or static fill level, prevents problems occurring in the prior art. For example such a problem occurs, when the dishwasher of the prior art uses only one level for calculating the flow rate and said dishwasher cannot by drained completely. The residual water from a last drain may disturb the calculation of the flow rate in the prior art dishwasher. As described already above, according to the present invention the predetermined lower water level and the predetermined upper or static fill level are both arranged in a suitable region of the sump pot, where there is not any problem with residual water.

An alternative embodiment of the static filling step of the invention provides that if any of the predetermined lower pressure P1 or the predetermined higher pressure P2 is exceeded already at the time T1, then a recorded value of the flow rate of the inlet water from a previous valid static filling can be set.

That might be necessary if there is an inadequately high volume of remaining water is in the sump pot, for example if the drainage step of the last program cycle did not function correctly or if the program cycle has been stopped prematurely. Said recorded value can then be used for the subsequent step of the percentaged filling according to the invention and for the feature fill-stop-timer of the invention.

According to a preferred embodiment the filling method of the present invention comprises the further subsequent step of starting a percentaged filling of the wash tub. The percentaged filling comprises the further consecutive step of: (vi) executing a percentaged filling of the wash tub after the upper water level of the static filling has been reached. The circulation pump is kept deactivated during the percentaged filling and a predetermined percentaged water volume is added to the wash tub by opening the water inlet for an open time corresponding to said percentaged water volume. Said open time is calculated basing on said percentaged water volume and on the inlet water flow rate determined during the static filling.

Further according to the above-described embodiment, the total water volume initially filled into the wash tub consists of said sump pot volume plus said percentaged water volume. Said total volume is lower, preferably slightly lower, or equal to a first operational water volume that is required for full load operation of the circulation pump at a first pump speed.

The aim of the percentaged filling step of the invention is to fill the wash tub with water as close as possible up to the operational level that is required when subsequently the circulation pump is switched on. The circulation pump generates an undesirable high noise level when it is operated while the water volume in the wash tub is too low and as a result the circulation pump sucks air. On the other hand it is undesirable for ecological reasons to fill more water into the wash tub than is required for a full load run of the circulation pump.

However, since both the water volume required by circulation pump at a predetermined pump speed for full load operation and the volume of the bottom region of the wash tub including in addition the sump pot are known with only minor tolerances, the invention aims at filling the wash tub with a predetermined water volume approaching closely the water volume required for full load operation before switching on the pump.

To solve that aim, the invention proposes to add a first predetermined partial water volume during the static filling step and to determine at the same time accurately the flow rate of the inlet water. Subsequently the remaining partial water volume is added as a percentaged water volume by opening the water inlet for a time basing on the calculated inlet water flow rate, wherein the circulation pump is still kept switched on. When subsequently the circulation pump is switched on during dynamic filling, only a small additional volume of water has to be filled in to achieve the more silent full load operation. Hence the invention allows to shorten considerably the time of undesirable loud noise without filling more water than needed.

Thus, the use of the calculated inlet water flow rate in percentaged filling allows to compensate tolerances in water inlet, the water connection and the geometry of the dishwasher. The percentaged filling controlled by the flow rate allows a shorter step of dynamic filling, which follows after the percentaged filling. Said shorter step of the dynamic filling allows a more quiet operation of the dishwasher, since the dynamic filling is relative loud.

According to a preferred embodiment the filling method of the present invention comprises the further subsequent step of starting a dynamic filling of the dishwasher, comprising the further subsequent steps of (vii) switching on the circulation pump and keeping it running at a first pump speed, (viii) detecting an insufficient operational water level in the wash tub that is lower than a known first required operational water level that corresponds to full load operation of the circulation pump at said first pump speed, and (ix) executing a dynamic filling of the wash tub while the circulation pump is running by opening the water inlet until said first required operational water level is detected inside the wash tub, preferably wherein both the insufficient operational water level and the first operational water level are detected by an analogous pressure sensor.

The circulation pump is activated with a certain speed. The water level drops, since the circulation pump and the pipes are filled. While the circulation pump is running a water inlet is opened until the analogue pressure sensor indicates that the water level for a normal operation has been reached. Then the water inlet is closed again. At this stage an initial filling routine has been finished, and the dishwasher operates with its standard parameters.

The dynamic filling step can be executed by activating the circulation pump with a predetermined rotation speed in order to simulate a certain mode of circulation. The amount of water in the dishwasher for a sufficient operation of the circulation pump can deviate from the standard conditions. The deviation can be caused by wetting of the wash load or filling of cavities of wash load, for example the cavities of cups that have been arranged in the wrong orientation inside the wash tub or that tumble over during the wash cycle. During the simulation mode all supply tubes, pipes, hoses and spray arms in the hydraulic circuit of the dishwasher are filled with water, so that the water level can be adjusted to a typical level for the specific operation mode. If the water level is lower than the operational level or a given target level, the water inlet will be activated in parallel until the required water level in the wash tub will be reached as monitored preferably by the analogue pressure sensor. Then, the water inlet will be deactivated, and the circulation pump can leave the simulation mode and change into the desired operational mode. Again, in the desired operational mode the required water level in the wash tub can be monitored, preferably by the analogue pressure sensor, and a dynamic refill step can executed as will be described further below.

The water level in the dishwasher is preferably monitored throughout the complete program cycle. The water level within the wash tub may be drop below an operational level due to several occurrences as already mentioned above. For example, foam or bubbles or wash load cavities turning upside up within the wash tub during the program cycle and collecting water. This lack of water can be corrected by a step of refilling.

The step of refilling generally is similar to the step of dynamic filling. Basically, the water inlet is opened as soon as the required operational level that corresponds to the actual pump speed is under-run. The water inlet is deactivated, when the water level has reached the required operational level again.

Preferably, the method for filling the wash tub comprises the further subsequent steps of (x) monitoring an operational water level in the wash tub while the circulation pump is running at a predetermined pump speed, (xi) detecting an operational level that is lower than a known required operational level that corresponds to said predetermined pump speed, (xii) starting a dynamic refilling of the dishwasher by opening the water inlet, and (xiii) stopping the dynamic refilling by closing the water inlet when said required operational water level is detected in the wash tub, preferably wherein the operational water level is monitored and/or detected by an analogous pressure sensor.

Preferably, a switch level of the water in the dishwasher for the analogue pressure sensor is preset. This switch level is effectively a switch back point and may be preset by software. At said switch level the step of dynamic refilling is started again until the required operational level has been reached.

The switch back point of the dynamic filling and for the dynamic refilling can be set differently as compared to a switch back point of the static filling, in order to avoid any multiple fillings or refillings during any later pulsed operations of the circulation pump.

In further embodiments of the first aspect of the present invention the required operational water level in the wash tub can be adjusted according to at least one predetermined further pump speed that is preferably used after the steps of dynamic filling and/or dynamic refilling or according to at least one predetermined operating characteristic of the circulation pump.

An operation characteristic can be for example the operation of the circulation pump at a constant pump speed or a pulsed operation of the circulation pump. A pulsed operation typically comprises operation of the circulation pump with at least two different pump speeds that alternate frequently at relatively short intervals during at least one stage of the wash cycle, such as e.g. a soaking stage, a pre-rinse stage, a wash stage, an intermediate rinse stage, or a clear rinse stage—all of which are known as such in the prior art, as is also the pulsed operation of the circulation pump.

The invention further provides that the required operational water level can be adjusted, in particular by dynamic refilling but also by subsequent adaptation as described below, to different pump speed and/or to different operating characteristics of the circulation pump. This is preferably executed by increasing the water level within the wash tub by opening the water inlet as required by an increase in the pump speed, whereas a lower pump speed requires a lower water level.

According to a further embodiment the method for filling the wash tub may comprise the further step of adapting a fill level of the water in the dishwasher to different flow rates of the circulation pump, on the basis of the flow rate of the inlet water as determined during static filling, wherein the analogue pressure sensor advantageously allows the setting of different levels.

In this case the method may comprise the step of adapting the filled amount of water in the dishwasher to the flow rate of the circulation pump, which can vary in the different steps of the program cycle. This step allows saving of water, since the amount of filled water can be adapted. In some phases of the program cycle less water can run through the dishwasher.

Further, the method comprises the further step of setting at least one switch level of the water in the dishwasher, at which the filling is started again until the operational water level has been reached, by measuring a pressure corresponding with one switch level by the analogue pressure sensor. The analogue pressure sensor allows different switch levels, at which the filling is started again.

The method can comprise subsequently adapting the filled-in amount of water in the wash tub to at least one further pump speed that can be higher or lower than a previous pump speed, in particular as compared to said first pump speed, wherein the pump speeds can be different in at least two steps of the program cycle and/or within at least two sub-steps of an individual step of the program cycle.

The further pump speed can be higher than said previous pump speed. Accordingly, the method can comprise executing a dynamic filling as has been described above, in particular wherein an insufficient operational water level can detected that is lower than a known required operational water level that corresponds to full load operation of the circulation pump at said further pump speed. In addition, said dynamic filling can be executed while the circulation pump is running by opening the water inlet until said required operational water level is detected.

The further pump speed can be lower than said previous and/or said higher pump speed, and the method can involve a step of an at least partial drainage of the water comprised in the wash tub. A subsequent step of executing a dynamic filling as described above while the circulation pump is running can be executed by opening the water inlet until a required operational water level that corresponds to said lower pump speed is detected.

A second aspect of the present invention refers to the use of the above-described novel filling routine of the invention in order to enhance the water safety of the dishwasher and to prevent an undesirable overflow of the water that is being filled into the wash tub.

To that end, the above-described filling method of the invention may comprise a further step of calculating a maximum open time of the water inlet of the dishwasher, in particular of a water inlet valve of the dishwasher. Said calculating step can in particular be executed after the water inlet has been closed in order to stop the above-described static filling of the sump pot. The maximum open time can be calculated basing on the known volume of the sump pot and the lower region of the wash tub and on the flow rate determined during the static filling step. The maximum open time of the water inlet can be used to prevent an overflow of the dishwasher.

As an important advantage, the maximum open time can be calculated taking into account the volume of the wash tub up that extends up to the lower edge of its frontal opening that can be closed by the frontal door. Thereby, the invention allows to adapt the volume of the filling water with previously unknown accuracy to the level of the lower edge of the door opening. This has the important consequences that a safety height of the lower edge of the door opening can be reduced and that the bottom of the wash tub can be designed more flat as in the prior art and that consequently the interior height of the wash tub and consequently the capacity of the wash tub can be importantly increased as compared to the prior art.

A particularly preferred further embodiment of the second aspect of the invention regarding the filling method that comprise the further step of calculating a maximum open time of the water inlet refers to the fill-stop-timer of the invention that will be described in the following.

Accordingly, the method of the invention that comprises at least the above-described step corresponding to the static filling comprises controlling an allowed maximum water level inside the wash tub that comprises the further subsequent steps of: (xiv) recording the actual total open time of the water inlet during all water filling steps of the present program cycle, (xv) calculating an allowed maximum total open time for the water inlet during a wash cycle basing on a known allowed maximum water volume inside the wash tub and on the flow rate of the inlet water determined during the static filling, and (xvi) calculating a remaining allowed maximum total open time for the water inlet (fill-stop-timer) .

In addition, the method regarding the fill-stop-timer can comprise the further subsequent step of (xvii) closing the water inlet when said allowed maximum total open time has been reached.

In alternative or still in addition, said method regarding the fill-stop-timer can comprise the further subsequent steps of: (xviii) determining the actual water level in the wash tub, (xix) starting an at least partial drainage of the water comprised in the wash tub by opening a drain valve or switching on a drain pump of the dishwasher, (xx) stopping the drainage when a predetermined drainage water level is detected in the wash tub, (xxi) calculating the volume of the drained water basing on the water levels before and after the drainage, preferably using an analogue pressure sensor, (xxii) calculating a supplemental filling time corresponding to the volume of the drained water basing on the inlet water flow rate determined during the static filing, and (xxiii) increasing the allowed maximum total open time for the water inlet (fill-stop-timer) by said supplemental filling time (corresponding reset of the fill-stop-timer).

In addition, said method regarding the fill-stop-timer can comprise an additional subsequent step of: (xxiv) adding a predetermined substitute volume of water by opening the water inlet for an open time that is calculated on the basis of said predetermined substitute volume water volume (19) and on the inlet water flow rate determined during the static filling, wherein said predetermined substitute volume of water is not allowed to be larger than the difference between said allowed maximum water level inside the wash tub (12) and said drainage water level.

The method regarding the fill-stop timer allows to execute a plurality of at least two or more subsequent stages of a program cycle, such as e.g. a soaking stage, a pre-rinse stage, a wash stage, an intermediate rinse stage, or a clear rinse stage—all of which are known as such in the prior art, that are separated from each other by a drainage or a partial drainage of the washing water and/or that require a different volume of water to be filled into the wash cycle and/or that involve some step of a drainage or a partial drainage of the washing water, and wherein a later complete or partial refill of the wash tub with inlet water is required. Irrespective of the aforementioned (partial) drainages and (partial) refills, the fill-stop-timer of the invention enables an electronic control device of the dishwasher at any given moment of a wash cycle to always accurately determine the actual volume of water inside the wash tub and to always reset the remaining allowed maximum total open time for the water inlet (fill-stop-timer) and the corresponding water volume that can still be filled safely.

The maximum open time of the water inlet can for example be activated, after the water inlet was closed or after an open command from a control unit.

The determination of the safety level may be performed by a system with own tolerances independent from the tolerances of the filling system. With the analogue pressure sensor the tolerances of the filling measurement and the safety level comes from one sensor and are therefore lower.

A third aspect of the present invention refers to the use of the above-described novel filling routine of the invention for the automatic timing of a regeneration cycle of a dishwasher that shall be executed after a total volume of water has been filled into the wash chamber that corresponds to a plurality of at least two or more subsequent wash cycles.

In the prior art execution of a corresponding number of wash cycles is usually monitored. However, this leads to an inaccurate time point of executing the regeneration cycle in those cases wherein the necessity of the regeneration cycle depends on the actual total amount of water that has been filled into the wash tub since the last regeneration cycle, because individual program cycles require different total amounts of filled water and usually the same wash cycle is not always used. As a result, water is wasted because for safety reasons the regeneration cycles in the prior art are more often executed as actually required.

In the following the present aspect of the invention is described with short reference to the regeneration of a water softening unit, which is itself well known in the prior art. However, the present invention relates to all regeneration cycles, both presently known and future, that are required in a dishwasher and that can or need to be timed according to the total volume of inlet water that has actually been filled into the wash tub since the last regeneration cycle.

The method comprises preferably at least the following subsequent steps: (xxv) recording the overall total open time of the water inlet during all water filling steps of the present program cycle and during all previous program cycles since a regeneration cycle of the dishwasher, in particular a regeneration cycle of a softener unit of the dishwasher, was last executed, (xxvi) calculating the total water volume that has been filled into the wash tub since the last generation cycle, basing on the flow rate of the inlet water determined during at least one static filling and on the recorded total open time of the water inlet since the last regeneration cycle, (xxvii) monitoring since the last regeneration cycle whether a predetermined regeneration-triggering volume of filling water has been filled into the wash tub (12), preferably using an analogue pressure sensor, and (xxviii) initiating a regeneration cycle of the dishwasher, in particular a regeneration cycle of a softener unit of the dishwasher, after said regeneration-triggering volume of filling water has been reached.

Additionally, the method may comprise the further step of calculating an amount of water which has passed through the dishwasher over the last few cycles in order to determine, when an additive has to be regenerated, on the basis of the flow rate in relation to the water volume between the upper water level and the lower water level in the dishwasher. Such an amount can be that amount of water, when the additive has to be regenerated. This calculation is performed at that moment, when the open time of the water inlet is counted. Possible uncertainties resulting from different inlet water flow rates can be eliminated by taking into account the flow rate. For example, the additive is a softener resin.

A fourth aspect of the present invention refers to indicating, whether a water inlet is closed, wherein the corresponding pressure is preferably detected by the analogue pressure sensor. For this purpose a timeout is set and starts with the opening of the water inlet. If this time is over before a pressure switch responds, there is indicated that the water tap is closed. The advantage of the analogue pressure sensor is that there be used another level, preferably the lowest measurable level. Thus, the offset time and the time till the indication may be shorter, so that the message received the user sooner.

Preferably, the method for filling a wash tub of a dishwasher with water, in particular according to any embodiment of the above-described novel filling routine of the invention, comprises the subsequent steps of (xxix) starting a program cycle of the dishwasher, (xxx) determining at the start of the program cycle whether a water inlet of the dishwasher could be opened, and (xxxi) eventually indicating to a user of the dishwasher that the water inlet could not be opened, wherein said determination involves executing a water level measurement in the bottom region of a water-collecting sump pot of the dishwasher essentially at the time of starting the program cycle, and preferably by measuring the water pressure using an analogue pressure sensor.

The failure to open the water inlet can be caused in principle by a user of the dishwasher that forgets to open a mains inlet tap in his kitchen or by a failure to open an electromagnetic water inlet valve, in particular a mains water inlet valve, of the dishwasher.

The above-mentioned method has the advantage over the prior art that the failure to open the water inlet can be detected and signaled much earlier than in the prior art. As described initially, a dishwasher is known from DE 198 28 768 C2 wherein the wash tub is filled with fresh water up to a minimum working level inside a sump pot that however is set such that the circulation the dishwashers does not suck air, wherein said minimum working level is measured by a level sensor that comprises an air trap and a pressure sensor. In such a dishwasher of the prior art the initial determination whether the water inlet could be opened or not bases on determining the first filled water level after a preset period of time after the start of the wash cycle that is known to be sufficient for filling said first water level. Therefore, in the dishwasher of the prior art a failure to open the water inlet cannot be detected and signaled to a user before the time required to fill said entire minimum working level has passed.

Differently, the present invention allows to determine and signal a failure to open the water inlet almost immediately after the start of a program cycle by executing a water level measurement in the bottom region of a water-collecting sump pot of the dishwasher essentially at the time of starting the program cycle, and preferably by measuring the water pressure using an analogue pressure sensor.

In a preferred embodiment as already described herein initially the first water level measured at the start of the filling method of the invention is the predetermined lower water level in the sump pot that is the starting level of the static filling that is arranged somewhat above the lower edge of an air trap connected to the pressure sensor, wherein the lower edge of the air trap is arranged at a small distance from the bottom of the sump pot arranged inside the sump pot. Thus, the determination and signaling whether the water inlet could be opened can be done after a very short time after the start of the program cycle corresponding to the time needed to fill the sump pot from its very bottom up to the predetermined lower water level that is arranged somewhat above the lower edge of the air trap that is arranged at a small distance from the bottom of the sump pot.

A fifth aspect of the present invention refers to a computer program product stored on a computer usable medium, comprising computer readable program means for causing a computer to perform the method of the invention of any of the above-described first to fourth aspect of the invention.

A sixth aspect of the present invention refers to a dishwasher 10, preferably comprising at least one analogue pressure sensor 20, wherein the dishwasher is adapted to execute the method of the invention of any of the above-described first to fourth aspect of the invention and/or to execute a the computer program product according to the aforementioned fifth aspect of the invention, in particular a dishwasher comprising an electronic control unit that is adapted to execute said method and/or said computer program product, preferably according to corresponding pressure signals provided by at least one analogue pressure sensor 20.

Figure 2:
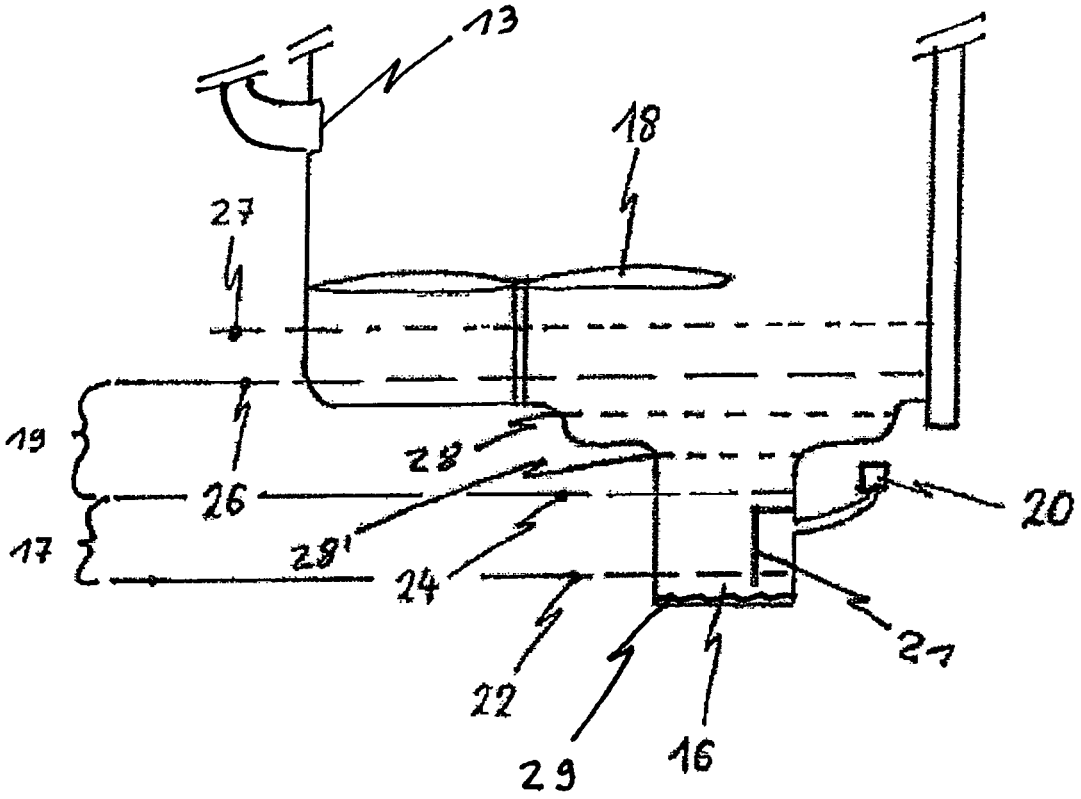

The present invention will be described in further detail by example of a preferred embodiment with reference to the accompanied drawings, in which FIG. 1 illustrates a schematic side view of a dishwasher according to a preferred embodiment of the present invention, and FIG. 2 is an enlarged sectional view of FIG. 1 with some added detail.

As shown in FIG. 1 the dishwasher 10 comprises a wash tub 12 for taking up wash load (not shown) that is delimited by a back wall (to the left), two opposing side walls (not shown), a top wall (at the top), a bottom at its lower end that has an opening that is fixed to a water-collecting sump pot 16, a frontal opening (to the right, not indicated) that in FIG. 1 is closed by the frontal loading door 14. At least one dishwasher sprayer 18 is arranged inside the wash tub 12 for spraying pressurized washing water onto the wash load. The dishwasher sprayer receives pressurized washing water from a circulation pump (not shown) of the dishwasher, wherein the circulation pump during operation sucks water from a corresponding opening (not shown) in the sump pot.

An analogue pressure sensor 20 is arranged besides the sump pot 16 and hydraulically connected to the sump pot by a connection pipe. The sump pot comprises an air trap 21 that shields the inlet of the connection pipe of the analogue pressure sensor from direct contact with the wash water.

As can be seen better in FIG. 2, the air trap has a lower free edge that is arranged at a relatively small distance from the bottom of the sump pot as compared to the overall height of the sump pot up to at least the predetermined upper water level. However, as can also be seen in FIG. 2 said distance is preferably large enough that a level of residual water 29 that remains inside the bottom region of the sump pot after a correctly executed final drainage step of a wash cycle does not reach the free lower edge of the air trap.

The predetermined lower water level 22 in the sump pot that is the starting level of the static filling is arranged somewhat above the lower edge of the air trap 21. Consequently, the predetermined lower water level 22, that is detected as a starting signal of the static filling step of the method of the invention of filling the wash (12) with water, gives a clearly different pressure signal of the analogue pressure sensor 20 as compared to an empty sump or to any level of residual water 29 that remains inside the bottom region of the sump pot after a correct final drainage step.

Within the sump pot 16 and within the lower portion of the wash tub 12, five different water levels 22, 24, 28', and 26 and 28, as well as an additional hypothetical water level 27, that however would only occur if the circulation pump were stopped when running under full-load conditions, are indicated.

The already mentioned predetermined lower water level 22 inside the sump pot 16 is the lowest level detected within the dishwasher 10 according to the invention. As already mentioned, the predetermined lower water level 22 is defined marginally above the bottom of the sump pot 16.

The predetermined upper water level 24 or static fill/water level 24 is depicted above the predetermined lower water level 22. The predetermined upper water level 24 is however preferably still within the lower region of the sump pot that has a favourable, relatively small cross section as compared to the bottom region of the wash chamber which is arranged on top of the sump pot that allows to determine with high accuracy the change of the volume between at least said predetermined lower water level and said predetermined upper water level 24 of the static filling step of the invention, as has been described herein above.

As also shown in the figures, the lower portion of the sump pot 16, which includes the predetermined lower water level 22 and the predetermined upper or static fill level 24, has a relative small cross-section. Thus, a change of the level in said lower portion of the sump pot 16 corresponds with a relative small change of the volume. In the example shown, the lower portion of the sump pot 16 has a cylindrical shape.

Since the detected pressure of the analogue pressure sensor 20 corresponds with the level, the change of the volume may be determined exactly. In a higher portion of the sump pot 16 and/or in the bottom region of the wash tub 12 that comprises an opening (not shown) to which the sump pot 16 is fixed the cross-section becomes wider. The volume between the predetermined lower water level 22 and the predetermined upper or static fill level 24 is predetermined and therefore well known. For example, the volume can be one liter.

In a lower portion of the wash tub 12 are in addition indicated: a percentaged fill level 26 corresponding to the total water level in the wash tub after both steps of static filling and of percentaged filling of the invention; a required operational water level 28 that corresponds to the minimum water level required in the wash tub 12 during operation of the circulation pump under full-load conditions at a predetermined pump speed; an insufficient operational level 28' that corresponds to an insufficient water volume in the wash tub 12 that does not allow a full-load operation of the circulation pump at a predetermined pump speed.

During the filling method of the invention, at first the water inlet 13 is opened and the sump pot 16 is filled with a small volume of water up to the predetermined lower water level 22 while the circulation pump is kept switched off. The precise volume of that filled water varies to an unknown extent, because it is not known whether the sump pot 16 is completely empty or whether a small amount of residual water 29 from the previous program cycle is still in the bottom region of the sump pot 16.

Subsequently, the lower predetermined water level 22 of the above-mentioned static filling is reached at the time point T1 and detected by the analogue pressure sensor as the pressure P1, and the measurement of the time for the static filling is started and the static filling begins by opening the water inlet 13, and wherein the circulation pump is still kept inactivated. When subsequently the predetermined upper or static fill level 24 is reached at the time point T2 and detected by the analogue pressure sensor as the pressure P2, wherein the circulation pump is still kept switched off, the static filling is stopped. Subsequently, the flow rate of the inlet water entering through the water inlet 13 is calculated basing on the duration of the time span between T1 and T2 and on the known sump pot volume 17 between the lower predetermined water level 22 and the predetermined upper or static fill level 24, which in the present example is one liter.

Subsequently, the percentaged filling step of the filling method of the invention is executed, wherein the predetermined percentaged water volume 19 is filled into the wash tub 12 by opening the water inlet 13 for a time corresponding to the predetermined percentaged water volume 1 and calculated basing on the flow rate of the inlet water calculated in the static filling step. After executing the percentaged filling step and while the circulation pump is still kept switched off, the wash tub 12 that communicates with the sump pot 16 has been filled up with water to the percentaged fill level 26, comprising a water volume that consists essentially of the sump pot volume 17 and the percentaged water volume 19.

The volume of water corresponding to the percentaged fill level 26 while the circulation pump is still switched off is almost sufficient or under ideal conditions is already sufficient for the operation of the circulation pump at a first, predetermined pump speed.

However, in most cases the dynamic water level within the wash tub 12 will subsequently drop from the percentaged fill level 26 to the insufficient operational level 28' when the circulation pump is switched on at a predetermined first pump speed and the wash water is sprayed through the at least one dish washer sprayer 18 and the entire wash tub 12 and the wash load therein is wettened. This effect is itself known in the prior art, wherein the magnitude of the dynamic water level drop is essentially proportional to the pump speed.

Subsequently, after switching on the circulation pump, the dynamic filling step of the filling method of the invention is executed by opening the water inlet 13 in order to fill up from the insufficient operational water level 28' to a known required operational water level 28 that is sufficient for full load operation of the circulation pump at the predetermined first pump speed. During the dynamic filling the circulation pump is being operated at said first predetermined pump speed. The dynamic filling step is again controlled using the analogue pressure sensor and the known operational water level 28 that corresponds to the full load operation of the circulation pump at the predetermined first pump speed.

The operational water level 28 is indicated in the figures above the insufficient operational water level 28'. Both refer to the dynamic conditions of operating of the circulation pump at the predetermined first pump speed. In contrast, the percentaged fill level 26 refers to the still switched off circulation pump. In the figures, the percentaged fill level 26 is indicated above both, the required operational water level 28 and the insufficient operational water level 28'. However, whereas the insufficient operational water level 28' necessarily is below the percentaged fill level 26 because of the dynamic water level drop upon switching on the circulation pump as described above, the operational water level 28 is not necessarily below the percentaged fill level 26 and the figures just show one possible situation.

In the figures the hypothetical water level 27 is in addition indicated, that however would only occur if the circulation pump were stopped while running under full-load conditions at said first predetermined pump speed. In the example shown, the hypothetical water level 27 shall correspond schematically to the required operational water level 28 that refers however to the dynamic conditions of the operating circulation pump. The hypothetical water level 27 is only indicated to illustrate schematically the rise in the water level as compared to the percentaged fill level 26 (that refers to the still switched-off circulation pump) that occurs during the dynamic filling.

Though the figures refer in an explicit way to an example of the filling routine according to the first aspect of the invention they can be used by analogy also for the illustration of the second to sixth aspects of the invention.

In particular, the figures can be used by analogy also for the illustration of the second aspect of the invention that refers to the use of the above-described novel filling routine in order to avoid an undesirable overflow of the water that is being filled into the wash tub 12. In particular the lower edge of the door opening is clearly shown in the figures. In addition, it is also readily understandable from the figures how the invention allows to design the bottom of the wash tub more flat as in the prior art and consequently to increase the capacity of the wash tub 12.

The figures can be used by analogy also for the illustration of the fourth aspect of the invention that refers to indicating whether the water inlet 13 is closed. In this regard FIG. 2 comprises a suitable schematic illustration of the relative orientation of the bottom of the sump pot 16, a residual water level 29 from a previous program cycle, the lower free edge of the air trap 21 and the predetermined lower water level 22 which corresponds to the lowest water level in the sump pot that is measured by the analogue pressure sensor 20 almost immediately after the start of the program cycle.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 dish washer
12 wash tub
13 water inlet
14 dish washer door
16 dish washer sump pot
17 sump pot volume
18 dish washer sprayer
19 percentaged water volume
20 analogue pressure sensor
21 air trap
22 lower water level
24 upper water level
26 percentaged fill level
27 hypothetical operational level (if circulation pump were stopped)
28 required operational level
28' insufficient operational level
29 residual water from a previous program cycle

The invention claimed is:

1. A method for filling a wash tub of a dishwasher with water, wherein the wash tub comprises a water-collecting sump pot that is fixed to an opening in its bottom and said method forms part of a program cycle for the operation of the dishwasher, said method comprising a step of:

(i) opening a water inlet of the dishwasher and executing a static filling of the wash tub wherein a circulation pump of the dishwasher is kept deactivated, (ii) detecting a predetermined lower water level inside the sump pot, (iii) starting to measure the time for the static filling when said lower water level is detected, (iv) detecting a predetermined upper water level inside the sump pot and stopping the static filling, (v) determining a flow rate of the inlet water during the static filling basing on the duration of the static filling and on a known sump pot volume comprised between said upper water level and said lower water level of the sump pot, (vi) executing a percentaged filling of the wash tub after the upper water level of the static filling has been reached, wherein the circulation pump is kept deactivated and a predetermined percentaged water volume is added to the wash tub by opening the water inlet for an open time corresponding to said percentaged water volume, wherein said open time is calculated based on said percentaged water volume and on the inlet water flow rate determined during the static filling, (vii) switching on the circulation pump and keeping it running at a first pump speed, (viii) detecting an insufficient operational water level in the wash tub that is lower than a known first required operational water level that corresponds to full load operation of the circulation pump at said first pump speed, (ix) executing a dynamic filling of the wash tub while the circulation pump is running by opening the water inlet until said first required operational water level is detected inside the wash tub, wherein both the insufficient operational water level and the first required operational water level are detected by an analogue pressure sensor, and (x) subsequently adapting the filled-in amount of water in the wash tub to at least one further pump speed that is higher or lower than said first pump speed during the program cycle, wherein the pump speeds can be different in at least two steps of the program cycle and/or within at least two sub-steps of an individual step of the program cycle, wherein when the further pump speed is higher than said first pump speed, wherein an insufficient operational water level is detected that is lower than a known required operational water level that corresponds to full load operation of the circulation pump at said further pump speed, and said dynamic filling is executed while the circulation pump is running by opening the water inlet until said required operational water level is detected, wherein when said further pump speed is lower than said first pump speed, involving a step of an at least partial drainage of the water comprised in the wash tub and a subsequent step of executing a dynamic filling while the circulation pump is running by opening the water inlet until a required operational water level that corresponds to said further pump speed is detected, and wherein the circulation pump is maintained at or above said further pump speed during the at least partial drainage and the subsequent step of executing the dynamic filling.

2. The method according to claim 1, wherein at least one of the lower water level and the upper water level in the sump pot are detected by at least one pressure sensor, wherein at least one of a lower pressure that corresponds to the lower water level and a higher pressure that corresponds to the upper water level in the sump pot are measured by the at least one pressure sensor, wherein the at least one pressure sensor comprises the analogue pressure sensor.

3. The method according to claim 1, wherein the total water volume initially filled into the wash tub consists of said sump pot volume plus said percentaged water volume, said total volume being lower or equal to a first operational water volume that is required for full load operation of the circulation pump at a first pump speed.

4. The method according to claim 1, that comprises the further steps of:

(xi) monitoring an operational water level in the wash tub while the circulation pump is running at a predetermined pump speed, (xii) detecting an operational level that is lower than a known required operational level that corresponds to said predetermined pump speed, (xiii) starting a dynamic refilling of the dishwasher by opening the water inlet, (xiv) stopping the dynamic refilling by closing the water inlet when said required operational water level is detected in the wash tub, wherein the operational water level is monitored and/or detected by the analogue pressure sensor.

5. The method according to claim 1, that comprises controlling an allowed maximum water level inside the wash tub and the subsequent steps of:

(xv) recording the actual total open time of the water inlet during all water filling steps of the present program cycle, (xvi) calculating an allowed maximum total open time for the water inlet during a wash cycle basing on a known allowed maximum water volume inside the wash tub and on the flow rate of the inlet water determined during the static filling, and (xvii) calculating a remaining allowed maximum total open time for the water inlet.

6. The method according to claim 5 that comprises the further subsequent step of:

(xviii) closing the water inlet when said allowed maximum total open time has been reached.

7. The method according to claim 5, comprising the further subsequent steps of:

(xix) determining the actual water level in the wash tub, (xx) starting an at least partial drainage of the water comprised in the wash tub by opening a drain valve or switching on a drain pump of the dishwasher, (xxi) stopping the drainage when a predetermined drainage water level is detected in the wash tub, (xxii) calculating the volume of the drained water basing on the water levels before and after the drainage using an analogue pressure sensor, (xxiii) calculating a supplemental filling time corresponding to the volume of the drained water basing on the inlet water flow rate determined during the static filing, and (xxiv) increasing the allowed maximum total open time for the water inlet by said supplemental filling time.

8. The method according to claim 7 that comprises an additional subsequent step of:

(xxv) adding a predetermined substitute volume of water by opening the water inlet for an open time that is calculated on the basis of said predetermined substitute volume water volume and on the inlet water flow rate determined during the static filling, wherein said predetermined substitute volume of water is not allowed to be larger than the difference between said allowed maximum water level inside the wash tub and said drainage water level.

9. The method according to claim 1, that comprises the subsequent steps of:

(xxvi) recording the overall total open time of the water inlet during all water filling steps of the present program cycle and during all previous program cycles since a regeneration cycle of a softener unit of the dishwasher was last executed, (xxvii) calculating the total water volume that has been filled into the wash tub since the last generation cycle, basing on the flow rate of the inlet water determined during at least one static filling and on the recorded total open time of the water inlet since the last regeneration cycle, (xxviii) monitoring since the last regeneration cycle whether a predetermined regeneration-triggering volume of filling water has been filled into the wash tub using an analogue pressure sensor, (xxix) initiating a regeneration cycle of a softener unit of the dishwasher, after said regeneration-triggering volume of filling water has been reached.

10. The method according to claim 1, wherein an analogue pressure sensor is used for detecting an operational water level or a regeneration-triggering volume of filling water.

11. The method for filling a wash tub of a dishwasher with water, according to claim 1, comprising the subsequent steps of:

(xxx) starting a program cycle of the dishwasher, (xxxi) determining at the start of the program cycle whether a water inlet of the dishwasher could be opened, and (xxxii) eventually indicating to a user of the dishwasher that the water inlet could not be opened, wherein said determination involves executing a water level measurement in the bottom region of a water-collecting sump pot of the dishwasher essentially at the time of starting the program cycle by measuring the water pressure using an analogue pressure sensor.

12. A computer program product stored on a non-transitory computer usable medium, comprising computer readable program means for causing an electronic control unit to perform the method according to claim 1.

13. Dishwasher comprising the at least one analogue pressure sensor, wherein the dishwasher is adapted to execute the method according to claim 1, wherein the dishwasher comprises an electronic control unit that is adapted to execute said method according to corresponding pressure signals provided by at least one analogue pressure sensor.

14. Dishwasher comprising the at least one analogue pressure sensor, wherein the dishwasher is adapted to execute said computer program product according to claim 12, wherein the dishwasher comprises the electronic control unit that is adapted to execute said computer program product according to corresponding pressure signals provided by the at least one analogue pressure sensor.

15. The method according to claim 1 further comprising draining the wash tub during a drain step, wherein the drain step further comprises calibrating the analogue pressure sensor while a drain pump is operating at an end of the drain step.

16. The method according to claim 1 further comprising pulsing the circulation pump when the further pump speed is operating.

17. The method according to claim 1, wherein the static filling step defines a first switch back point comprising a first value of the analogue pressure sensor and the dynamic filling step defines a second switch back point comprising a second value of the analogue pressure sensor, wherein the first switch back point is different than the second switch back point.

18. A method for filling a wash tub of a dishwasher with water, wherein the wash tub comprises a water-collecting sump pot that is fixed to an opening in its bottom and said method forms part of a program cycle for the operation of the dishwasher, said method comprising a step of:

(i) opening a water inlet of the dishwasher and executing a static filling of the wash tub wherein a circulation pump of the dishwasher is kept deactivated, (ii) detecting a predetermined lower water level inside the sump pot, (iii) starting to measure the time for the static filling when said lower water level is detected, (iv) detecting a predetermined upper water level inside the sump pot and stopping the static filling, (v) determining a flow rate of the inlet water during the static filling basing on the duration of the static filling and on a known sump pot volume comprised between said upper water level and said lower water level of the sump pot, (vi) executing a percentaged filling of the wash tub after the upper water level of the static filling has been reached, wherein the circulation pump is kept deactivated and a predetermined percentaged water volume is added to the wash tub by opening the water inlet for an open time corresponding to said percentaged water volume, wherein said open time is calculated based on said percentaged water volume and on the inlet water flow rate determined during the static filling, (vii) switching on the circulation pump and keeping it running at a first pump speed, (viii) detecting an insufficient operational water level in the wash tub that is lower than a known first required operational water level that corresponds to full load operation of the circulation pump at said first pump speed, (ix) executing a dynamic filling of the wash tub while the circulation pump is running by opening the water inlet until said first required operational water level is detected inside the wash tub, wherein both the insufficient operational water level and the first required operational water level are detected by an analogue pressure sensor, and (x) draining the wash tub during a drain step, wherein the drain step further comprises calibrating the analogue pressure sensor while a drain pump is operating at an end of the drain step.

* * * * *